United States Patent [19]

Kuznetz

[11] Patent Number: 4,813,160

[45] Date of Patent: Mar. 21, 1989

[54] VENTILATED AND INSULATED ATHLETIC SHOE

[76] Inventor: Lawrence Kuznetz, 418 Boynton Ave., Berkeley, Calif. 94707

[21] Appl. No.: 107,006

[22] Filed: Oct. 13, 1987

[51] Int. Cl.[4] ..... A43B 7/06; A43B 23/00

[52] U.S. Cl. ..... 36/3 R; 36/3 B; 36/45

[58] Field of Search ..... 36/3 B, 3 R, 29, 28, 36/43, 44, 30 A, 45, 47, 48, 49; 128/588; 2/81; 374/162

[56] References Cited

U.S. PATENT DOCUMENTS

| | | | |
|---|---|---|---|
| 2,096,511 | 10/1937 | Gordon | 36/30 A |
| 3,591,400 | 7/1971 | Palmquist et al. | 2/81 X |
| 3,704,625 | 12/1972 | Seto et al. | 374/162 |
| 4,438,573 | 3/1984 | McBarron | 36/3 B |
| 4,445,284 | 5/1984 | Sakutori | 36/3 B |
| 4,617,745 | 10/1986 | Batra | 36/3 B |

FOREIGN PATENT DOCUMENTS

| | | | |
|---|---|---|---|
| 2164963 | 7/1973 | Fed. Rep. of Germany | 36/3 B |
| 1096156 | 3/1955 | France | 36/3 B |
| 291599 | 12/1931 | Italy | 36/3 B |
| 21944 | of 1913 | United Kingdom | 36/3 B |

*Primary Examiner*—James Kee Chi

*Attorney, Agent, or Firm*—Michael Ebert

[57] ABSTRACT

An athletic shoe adapted to maintain a foot housed therein in a relatively cool and dry state despite heat and moisture developed within the shoe interior in the course of activity. The shoe upper is provided with a metallized coating to reflect incident solar radiation. The shoe includes a ground-engaging outer sole, an inner sole and a contoured compressible inner liner which engages the plantar area of the foot. Interposed between the inner and outer soles is a thin insulating insert acting as a thermal barrier minimizing the conduction of ground heat to the shoe interior. Embedded in the inner sole is an array of tubes each extending along a diagonal axis and terminating at its leading end in an air scoop that projects from the outer side of the inner sole to intercept relatively cool ambient air. The trailing end of the tube has an air flow restrictor therein and terminates in a discharge outlet that projects from the inner side of the inner sole, the restrictor acting to reduce the discharge of the cool air. Each tube is provided with at least one lateral port that communicates with the shoe interior through a duct passing through the inner liner. In the course of activity, the shoe is cyclically raised by the wearer above ground and then brought down in contact therewith, as a result of which the foot acts to compress the inner liner to force hot and moist air from the interior into the duct and through the tube for expulsion into the atmosphere from the discharge outlet.

6 Claims, 2 Drawing Sheets

Fig. 1.
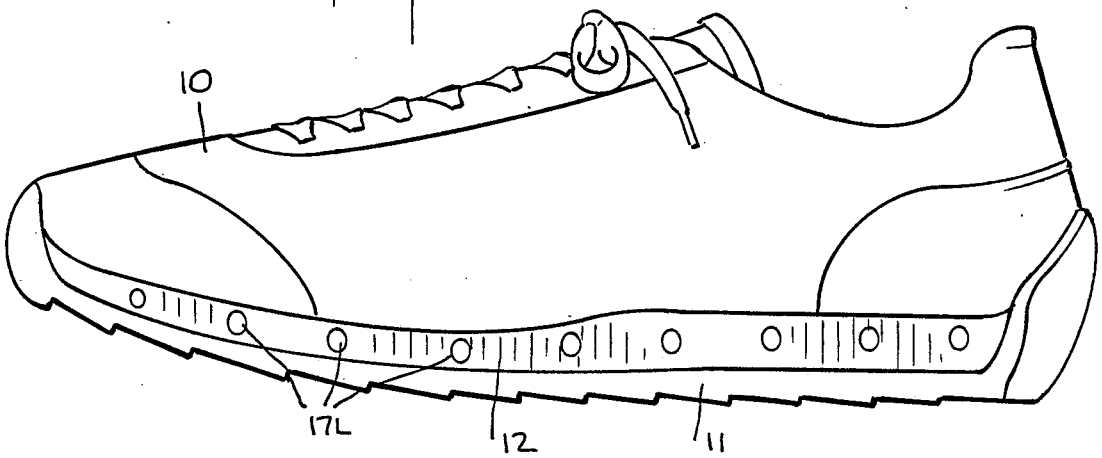
Fig. 2
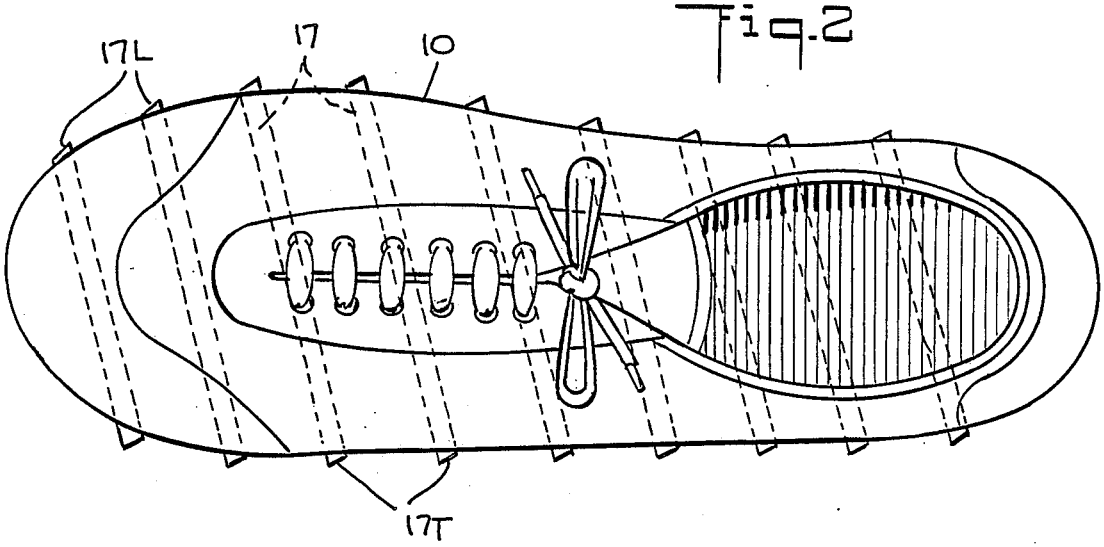
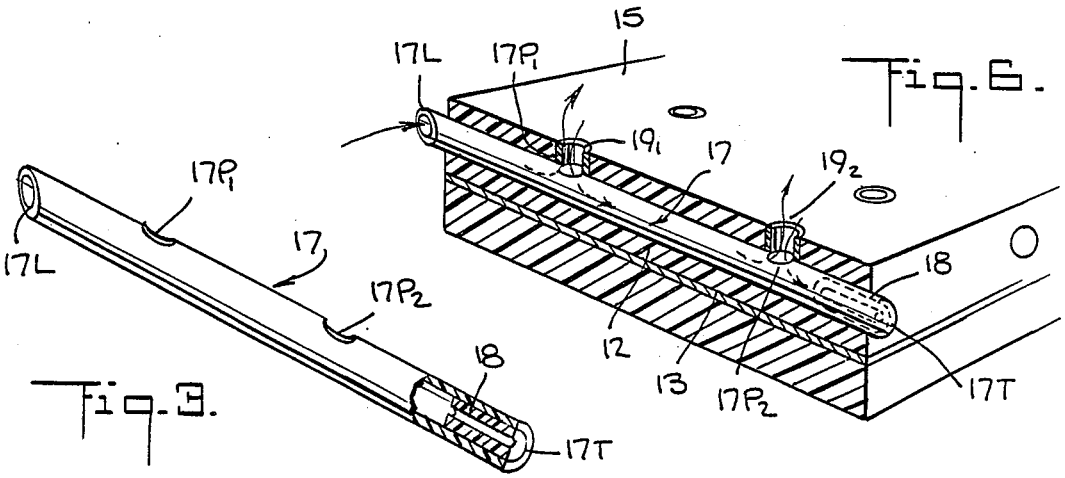
Fig. 6.
Fig. 3.

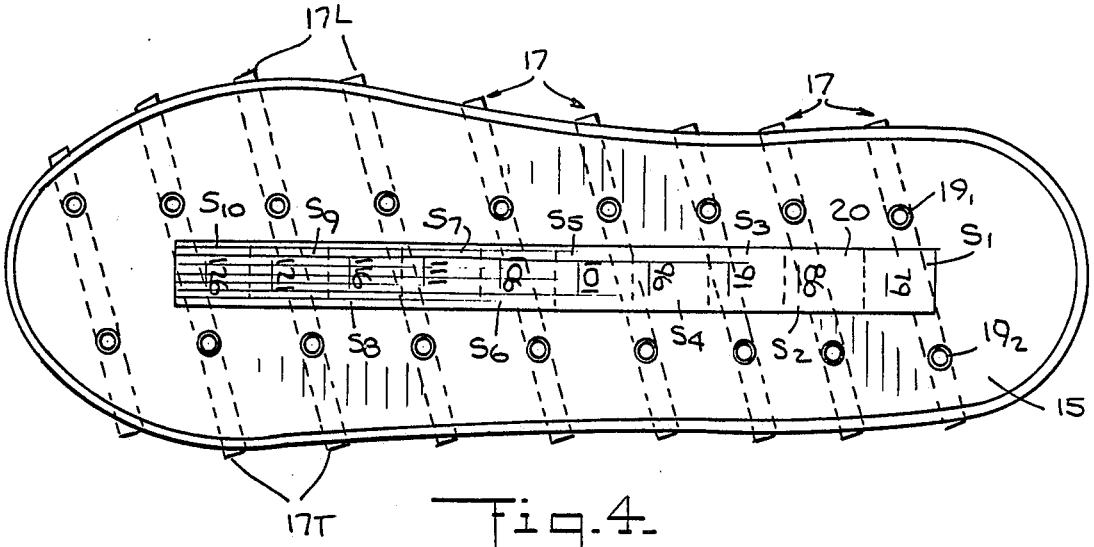
Fig. 4.
Fig. 5.
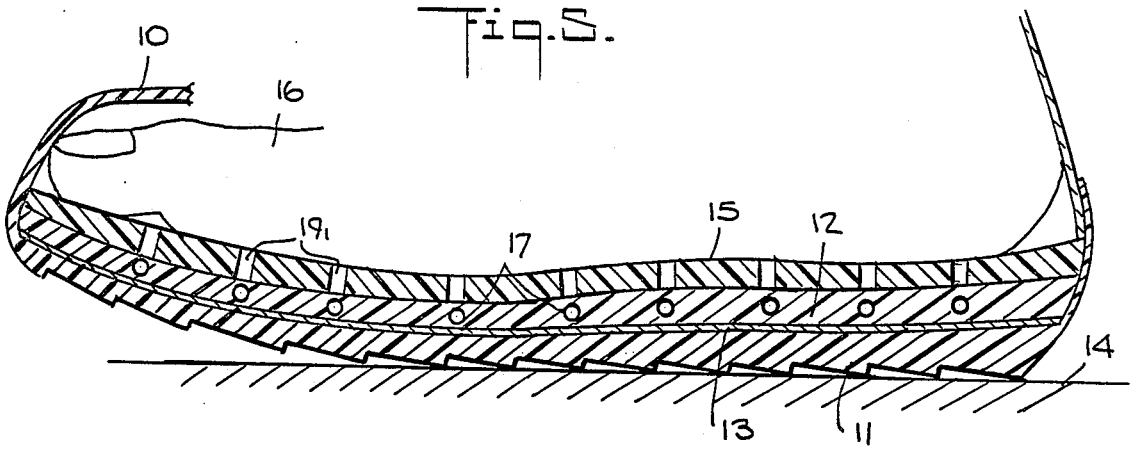
Fig. 7.
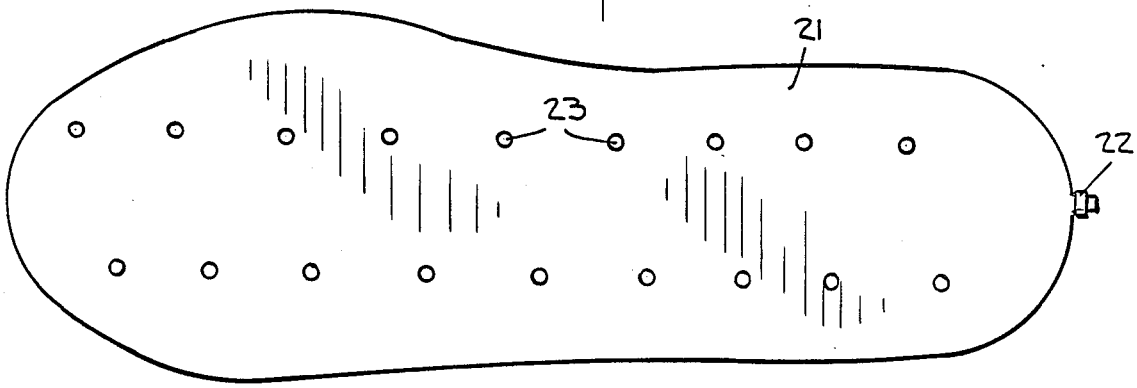

VENTILATED AND INSULATED ATHLETIC SHOE

BACKGROUND OF INVENTION

1. Field of Invention:

This invention relates generally to athletic shoes, and more particularly to a shoe that is so insulated as to minimize heating of a foot housed therein as a result of solar radiation and heat conduction from the ground, and which is so ventilated as to draw into the shoe interior relatively cool ambient air and to discharge therefrom moist and warm air developed as a result of athletic activity, whereby the foot is maintained in a relatively dry and cool state.

2. Status of Prior Art:

Because of exertions involved in sports activities such as running and jogging, a wearer of athletic shoes is subjected to the adverse effects of the moist and relatively warm air developed within the interior of the shoe as a result of perspiration and heat. Thus marathon racing tests have shown that when the ambient temperature is about 80° F., the internal shoe temperature in some instances exceeds 110° F. Shoes which are hot and moist are not conducive to athletic activity nor are they beneficial to the feet. And apart from the fact that shoes are rendered uncomfortable by internally-developed moist and warm air having a high salt content, this vapor attacks the materials from which the shoes are fabricated and shortens their effective life.

The transfer of heat takes place by three processes: conduction, convection and radiation. In conduction, heat is transferred through a body by the short range interaction of molecules and/or electrons. Convection involves the transfer of heat by the combined mechanisms of fluid mixing and conduction. In radiation, electromagnetic energy is emitted toward a body and the energy incident thereto is absorbed by the body to raise its temperature. Radiant heating, therefore, differs from both convection and conduction heating, for the presence of matter is not required for the transmission of radiant energy.

In conduction and convection heating, the rate of heat transfer is proportional only to the temperature difference between the body being heated and the surrounding transfer medium; hence such heating is relatively slow as compared to the nearly instantaneous effect of radiant heating.

An athletic shoe is subjected to heat build-up and rendered uncomfortable because of heat arising from three distinct sources. The first is heat resulting from exposure of the shoe to incident solar radiation. The extent to which radiant heat presents a problem depends, of course, upon where the athletic activity is being carried out. On a sunny day, solar radiation may be a significant factor.

The second source is ground heat conducted to the shoe interior through the sole of the foot. Such ground het, in some instances, particularly when the wearer is running on a hard, paved surface exposed to the sun, may lead to a heavy heat build-up, thereby causing profuse perspiration on the part of the wearer. The third source of heat is a result of internal friction when the housed foot rubs against the inner liner of the shoe. Where an athletic shoe makes use of flexible foam rubber or plastic materials for the inner and outer soles as well as the inner liner, because of the heat insulating capacities of these materials, they contribute to heat build-up.

The idea of incorporating ventilating means in a shoe to introduce cooling air therein appears repeatedly in the prior art. Thus the patent to Marabini, U.S. Pat. No. 1,225,455, shows a shoe having an elastic tube therein to compress air drawn from the exterior and to force this air into the shoe interior.

The Brahm patent U.S. Pat. No. 3,475,836 provides an air pumping action in a shoe, air being drawn through a valve and being forced out of openings. Similar pneumatic pumping schemes are shown in Estandian, U.S. Pat. Nos. 3,315,379, in Karras, 3,331,146, El Sakkaff, 4,602,441 and Lee, 4,654,982.

The incorporation of air scoops in shoes to pick up air and feed the air into the shoe interior is found in Berlese, U.S. Pat. Nos. 4,679,335; Dassler, 4,100,685; Kim, 4,224,746; Inohara, 4,359,830; McBarron, 4,438,573 and Sakutori, 4,445,284. Also of interest in regard to shoe ventilation are the patents to Doak, U.S. Pat. Nos. 4,397,104; Fukuoka, 4,468,869 and Stec, 3,335,505.

While the prior art provides various expedients to effect shoe ventilation, the means for this purpose are relatively inefficient, for they fail to separate the hot and moist air developed within the shoe interior from the incoming cool air, so that it is not mainly the damp air which is discharged. Also, the prior art does not take into account the effect of solar radiation and ground heat on heat build-up within the shoe.

SUMMARY OF INVENTION

In view of the foregoing, the main object of this invention is to provide an athletic shoe adapted to maintain the foot housed therein in a relatively cool and dry state in the course of an athletic activity.

More particularly, an object of this invention is to provide an athletic shoe which minimizes heat build-up resulting from solar radiation, ground heat and internal friction.

A significant advantage of the invention is that the hot and moist air developed within the shoe interior is forcibly discharged therefrom when the shoe repeatedly makes contact with the ground in the course of an athletic activity.

Also an object of the invention is to provide a shoe inner liner with a planar temperature indicator which does not interfere with the wearing qualities of the shoe, yet gives the wearer a useful reading of internal shoe temperature.

Briefly stated, these objects are attained in an athletic shoe adapted to maintain a foot housed therein in a relatively cool and dry state despite heat and moisture developed within the shoe interior in the course of activity. The shoe upper is provided with a metallized coating to reflect incident solar radiation. The shoe includes a ground-engaging outer sole, an inner sole and a contoured compressible inner liner which engages the plantar area of the foot. Interposed between the inner and outer soles is a thin insulating insert acting as a thermal barrier minimizing the conduction of ground heat to the shoe interior. Embedded in the inner sole is an array of tubes each extending along a diagonal axis and terminating at its leading end in an air scoop that projects from the outer side of the inner sole to intercept relatively cool ambient air. The trailing end of the tube has an air flow restrictor therein and terminates in a discharge outlet that projects from the inner side of the inner sole, the restrictor acting to reduce the discharge of the cool air. Each tube is provided with at least one lateral port that communicates with the shoe interior through a duct passing through the inner liner. In the course of activity, the shoe is cyclically raised by the wearer above ground and then brought down in contact therewith, as a result of which the foot acts to compress the inner liner to force hot and moist air from the interior into the duct and through the tube for expulsion into the atmosphere from the discharge outlet.

BRIEF DESCRIPTION OF DRAWING

For a better understanding of the invention as well as other objects and further features thereof, reference is made to the following detailed description to be read in conjunction with the accompanying drawings, wherein:

FIG. 1 is an elevational view of an athletic shoe in accordance with the invention;

FIG. 2 is a top view of the shoe;

FIG. 3 shows one of the tubes included in an array thereof embedded in the inner sole of the shoe;

FIG. 4 separately shows the inner liner of the shoe;

FIG. 5 is a longitudinal section taken through the shoe;

FIG. 6 illustrates the ventilating action; and

FIG. 7 shows an alternative means for ventilating the shoe.

DESCRIPTION OF INVENTION

First Embodiment:

Referring now to FIGS. 1 to 5, there is shown an athletic shoe in accordance with the invention. The shoe is of the laced type (by way of example) and includes an upper 10, preferably formed primarily of fabric or any other light-weight material of high flexibility suitable for an athletic shoe. The outer surface of upper 10 is provided with a highly reflective metallic coating adapted to reflect incident solar radiation to reduce the effects of such radiation on heating of the shoe interior. Thus the fabric material used for the shoe upper may be of the type used in ski jackets, the fabric fibers being aluminized. Aluminization may be effected by vaccum deposition, sputtering or any other known metallizing technique.

The shoe includes an outer sole 11 whose undersurface is in a tread formation to resist slippage. The sole is preferably fabricated of a flexible, synthetic plastic composition of high density and strength appropriate to athletic shoes. Also provided is an inner sole 12, preferably formed of compressible sponge rubber or flexible foam plastic material having shock-cushioning properties.

As shown in FIG. 5, sandwiched between inner sole 11 and outer sole 12 is an insert 13 formed of fibrous thermal insulation material having extremely low thermal-conductivity characteristics. Suitable for this purpose is a thin pad constituted by fine silica or glass fibers having air entrapped therein. This insert functions as a thermal barrier to minimize conduction of heat from the ground surface 14 to the shoe interior.

Overlying inner sole 12 is an inner liner 15 which is contoured to generally conform to the foot 16 of the wearer of the shoe, the inner liner being engaged by the plantar area of the foot. Liner 15 is fabricated of a compressible material which is the same as or similar to the material of the inner sole and therefore has cushioning characteristics. Or the inner liner may be a laminate formed by a layer of flexible foam plastic material and an upper layer of felted fabric material.

Embedded in inner sole 12 is a horizontal array of flexible, synthetic plastic tubes 17 made of polyvinyl chloride or similar material, each tube extending along a diagonal axis that is inclined relative to the longitudinal axis of the shoe. The leading end of each tube is closer to the toe of the shoe than the trailing end thereof and is cut at an angle to define an air scoop 17L which projects slightly from the outer side of the inner sole. The air scoop faces forwardly and therefore acts to intercept relatively cool ambient air as the wearer moves the shoe in the forward direction in the course of athletic activity. By this scooping action, cool air is forced into tube 17; and since the shoe is provided with an array of such tubes, a relatively large volume of cool air is captured thereby.

The trailing end of each tube 17 is cut at an angle opposed to that of the air scoop 17L and projects slightly from the inner side of inner sole 12 to define a rearwardly-facing discharge outlet 17T. As shown in FIG. 3, fitting snugly within the trailing end portion of each tube 17 is a sleeve 18 having a relatively small bore which acts effectively to reduce the inner diameter of the tube and therefore functions as a flow restrictor.

Hence when incoming cool air is forced into tube 17 by air scoop 17L, because this flow is impeded by sleeve 18 from flowing into the discharge outlet 17T, it seeks instead to flow out of relatively large diameter lateral ports $17P_1$ and $17P_2$. These ports are disposed at spaced positions intermediate the leading and trailing ends of the tube and lie in registration with ducts $19_1$ and $19_2$ formed in inner liner 15 and inner sole 12, as best seen in FIG. 5.

When in the course of each cycle of the wearer's activity, the shoe is raised above ground and brought forward, this action causes cool air to be picked up by the air scoops and forced into tubes 17, the cool air then flowing into the interior of the shoe through ducts $19_1$ and $19_2$. This flow is indicated by arrows in FIG. 6. When the shoe is raised, the sole of the foot is then slightly separated from the inner liner 15 so that the incoming cool air is then free to enter the interior.

But each time the shoe is brought into contact with the ground, the foot then acts to compress the inner liner and in doing so forces hot and moist air developed within the interior as a result of athletic activity into ducts $19_1$ and $19_2$. Because in the leading portion of tube 17 there is an incoming forced flow of cool air, this acts to effectively impede a counter flow in the leading portion of warm and moist air introduced into the tube through the ducts. However, the flow of hot and moist air is not impeded by air flow in the same direction in the trailing portion of tube 17; hence the forced flow of hot and moist air is diverted from the leading end of the tube and directed toward the discharge outlet 17T where it is vented into the atmosphere.

Thus a shoe in accordance with the invention takes into account all three sources of heat. Solar heating is minimized by the aluminized coating which reflects radiant energy from the shoe upper. The insulating insert acts as a barrier to minimize heat conduction from the ground into the shoe interior, and the ventilating tubes act to introduce cool air into the interior and to remove hot and damp air therefrom resulting from internal friction and perspiration.

Temperature Indicator:

Bonded to the inner surface of inner liner 15 at a position thereon intermediate ducts $19_1$ and $19_2$ is a flexible strip 20 functioning as a digital thermometer.

Incorporated in a strip 20 is a longitudinal series of temperature-sensitive liquid crystal stations $S_1$ to $S_{10}$ which are responsive in progressive steps to increasingly higher temperature levels. The nature of the liquid crystals in the stations is such that each station has a predetermined temperature threshold below which the crystals will not be activated. Thus when the interior shoe temperature reaches 79°, only the first station $S_1$ will be activated to read 79° F. And when the interior temperature rises to 121° F., only then will the station $S_9$ be activated to read 121° F. Intermediate levels of temperature are indicated by stations $S_2$ to $S_8$.

In this way, the wearer of the shoe can on occasion check the interior shoe temperature to be sure that it is at an acceptable level.

Second Embodiment:

FIG. 7 shows an alternative form of ventilator, the shoe in other respects including an insulating insert and an aluminized upper as in the first embodiment.

The ventilator for the shoe is in the form of a generally flat bladder 21 of flexible plastic material contoured to conform to the inner sole of the shoe, the bladder having upper and lower layers which in the normal state of the bladder are separated to define a shallow cavity between the layers. The bladder is fabricated of a material having a strong memory so that it maintains its normal state until pressure is applied thereto by the foot to compress the bladder and collapse the cavity, the bladder resuming its normal state when the pressure is released. When the shoe containing the bladder is lifted above ground, pressure on the bladder is released; and when the shoe is brought down into contact with the ground, the sole of the foot acts to compress the bladder.

The rear end of bladder 21 is coupled to a tube which extends through the heel end of the shoe upper and terminates in an air inlet 22 having a unidirectional valve therein which permits air to be admitted into the bladder but block the passage of air from the bladder to the inlet. The upper layer of the bladder has an array of small holes 23 therein such that when the air-filled bladder is compressed, the air therein is expelled through these holes into the shoe interior.

Thus in the course of a shoe cycle, when the shoe is raised above ground and the bladder pressure is released, the bladder resumes its normal state and in doing so creates a negative pressure causing cool air to be drawn through tube 21 into the cavity. When the shoe is brought down and the sole of the foot compresses the bladder, this action causes expulsion of the cool air into the shoe interior. In this case, the upper of the shoe may be provided with perforations so that as cool air is forced into the interior, this acts to drive out warm and moist air through the perforations.

While there have been shown and described preferred embodiments of a ventilated and insulated athletic shoe in accordance with the invention, it will be appreciated that many changes and modifications may be made therein without, however, departing from the essential spirit thereof. Thus in the first embodiment, instead of drawing cool air into tubes 17, one may insert into each of these tubes a plug of gel material as a freezing agent having a high storage capacity, the plug having been previously frozen so as to provide within the tubes a refrigerant acting to cool the shoe for a fairly prolonged period sufficient to complete a race or other competitive sports activity.

In order to obtain an adequate volume of cool incoming air, the inner diameter of the tubes should be at least ⅜" and preferably ½". And while the tubes are shown as being of uniform diameter throughout their length, in practice the tubes may be formed into a Venturi configuration to create a negative pressure to expel the moist and warm air.

I claim:

1. An athletic shoe adapted to maintain a foot house therein in a relatively cool and dry state despite heat and moisture developed with the shoe interior in the course of activity, said shoe comprising:

A an upper;

B an outer sole which engages the ground;

C an inner sole above the outer sole;

D a thin insert interposed between the inner an outer soles formed of a fibrous material having an extremely low thermal conductivity to create a barrier minimizing the conduction of ground heat to the interior of the shoe; and E ventilating means to draw relatively cool ambient air from the atmosphere into the interior of the shoe and a discharge outlet to discharge warmed air from the interior of the shoe into the atmosphere, said ventilating means being constituted by an array of tubes embedded in said inner sole, each tube extending along a diagonal axis whereby the leading end of each tube is closer to the toe of the shoe than the trailing end thereof, the leading end projecting from the outer side of the inner sole and being shaped to define an air scoop to intercept said ambient air, said trailing end projecting from the inner said of the inner sole and being shaped to define a discharge outlet, each tube having at least one lateral port which communicates through a duct in the inner sole with the shoe interior.

2. A shoe as set forth in claim 1, wherein said upper is provided with a metallized coating to reflect incident solar radiation.

3. A shoe as set forth in claim 2, wherein said insert is formed of non-woven fiberglass having air entrapped therein.

4. A shoe as set forth in claim 1, wherein said inner sole is formed of flexible foam material.

5. A shoe as set forth in claim 1, further including a contoured inner liner overlying said inner sole and generally conforming to the foot of the wearer whose plantar area engages the inner liner, said inner liner having a duct therein which registers with the duct in the inner sole.

6. A shoe as set forth in claim 5, wherein each tube is provided with a small bore sleeve that fits into the trailing end thereof to restrict the flow of air into the discharge outlet whereby the flow of ambient air drawn into the tube is caused to flow mainly toward the port whose diameter is greater than that of the bore, whereas warm and moist air developed within the interior of the shoe is forced by the foot when the shoe is brought down through the duct toward the trailing end of the tube to be discharged through the outlet.

* * * * *